United States Patent [19]

Powers et al.

[11] 3,941,690

[45] Mar. 2, 1976

[54] PORTABLE SLUICE PAN

[75] Inventors: Michael D. Powers; William J. Piton, both of Spokane, Wash.

[73] Assignee: William J. Piton, Spokane, Wash.

[22] Filed: Nov. 29, 1974

[21] Appl. No.: 528,429

[52] U.S. Cl. ..... 209/443; 209/458; 209/485; 209/44

[51] Int. Cl.[2] ..... B03B 5/26

[58] Field of Search ..... 209/44, 435, 443, 455, 209/485, 506, 508, 260, 441, 460, 497, 499

[56] References Cited

UNITED STATES PATENTS

| | | | |
|---|---|---|---|
| X-Series | 9/1832 | Willis | 209/44 |
| 528,503 | 10/1894 | Chatterson | 209/44 |
| 1,491,649 | 4/1924 | Wiegand | 209/497 X |
| 2,294,587 | 9/1942 | Vissac | 209/458 |
| 2,926,786 | 3/1960 | Craft et al. | 209/458 |
| 3,232,426 | 2/1966 | Caparrella et al. | 209/44 |
| 3,682,304 | 8/1972 | Seidel | 209/443 |
| 3,833,120 | 9/1974 | Ogata | 209/399 |

*Primary Examiner*—Frank W. Lutter
*Assistant Examiner*—Ralph J. Hill
*Attorney, Agent, or Firm*—Wells, St. John & Roberts

[57] ABSTRACT

A portable sluice pan is described for panning for gold and other valuable heavy minerals from placer deposits. The pan includes an elongated trough having a feed hopper at one end and a removable flexible riffle mat in the bottom of the trough to cause the placer pulp to flow in a turbulent manner over the riffles to stratify the heavier and lighter materials. The sluice pan is constructed of light weight material such as aluminum and may be hand held during operation.

8 Claims, 4 Drawing Figures

PORTABLE SLUICE PAN

BACKGROUND OF THE INVENTION

This invention relates to devices for panning for gold and other valuable heavy minerals from placer material.

Traditionally, the principal means of panning for gold involved the use of a pie shaped pan in which the placer material and water are placed in the pan and then the pan is agitated in reciprocating motion to separate and stratify the heavier particles by specific gravity from the lighter particles.

It is a principal object of this invention to provide a more efficient device for panning for gold and separating the more valuable materials such as gold, sapphire, garnets and black sand, which may contain platinum, from less valuable materials and sands.

A further objective of this invention is to provide a sluice pan that is portable and lightweight and may be easily carried on one's back.

A further object of this invention is to provide a very inexpensive sluice pan that may be readily utilized by novice and professional alike in recovering gold and other valuable materials from placer deposits.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which.

DETAILED DESCRIPTION OF A PREFERRED EMBODIMENT

Figure 1:
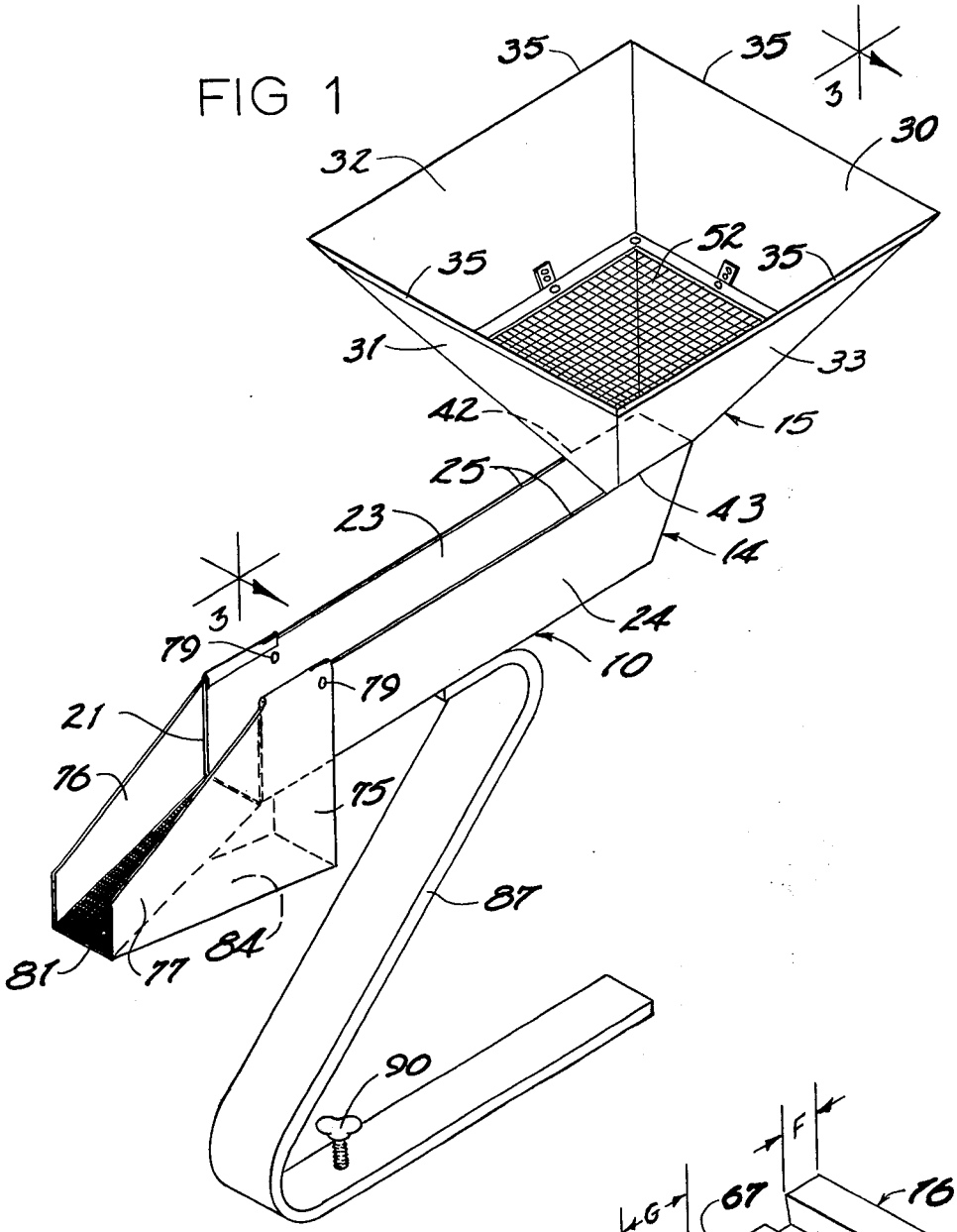
FIG. 1 is a perspective view of a portable sluice pan incorporating the principal features of this invention.
Figure 2:
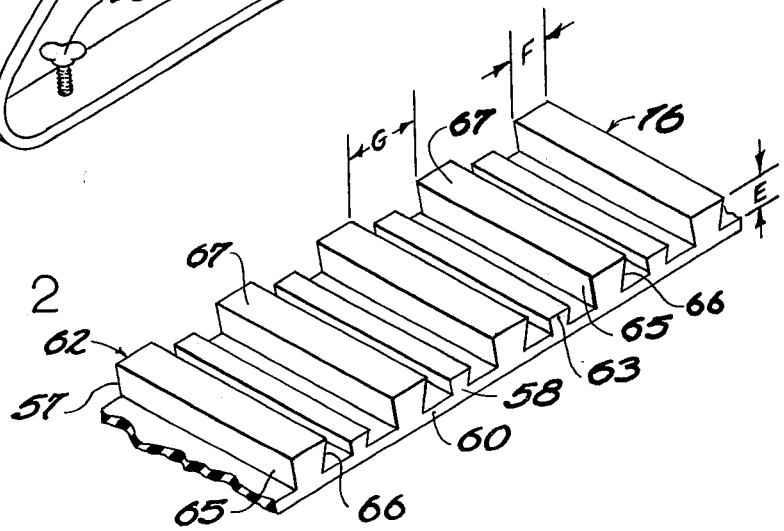
FIG. 2 is a perspective view of a fragmentary portion of a flexible riffle mat illustrating a riffle configuration.

Referring now in detail to the drawings, there is illustrated in FIG. 1 a portable sluice pan which is the subject of this invention for receiving placer deposit material and water to form a placer pulp and to process the pulp and efficiently separate heavier specific gravity materials such as sapphire, garnets, gold, black sand from lighter materials while discharging the lighter materials from the pan and retaining the heavier specific gravity material therein. The placer pulp formed by the mixture of water and placer material, is identified with the numeral 11 as it is processed through the sluice pan.

The sluice pan 10 contains three principal components — (1) sluice trough 14; (2) hopper 15; and (3) riffle mat 16.

Figure 3:
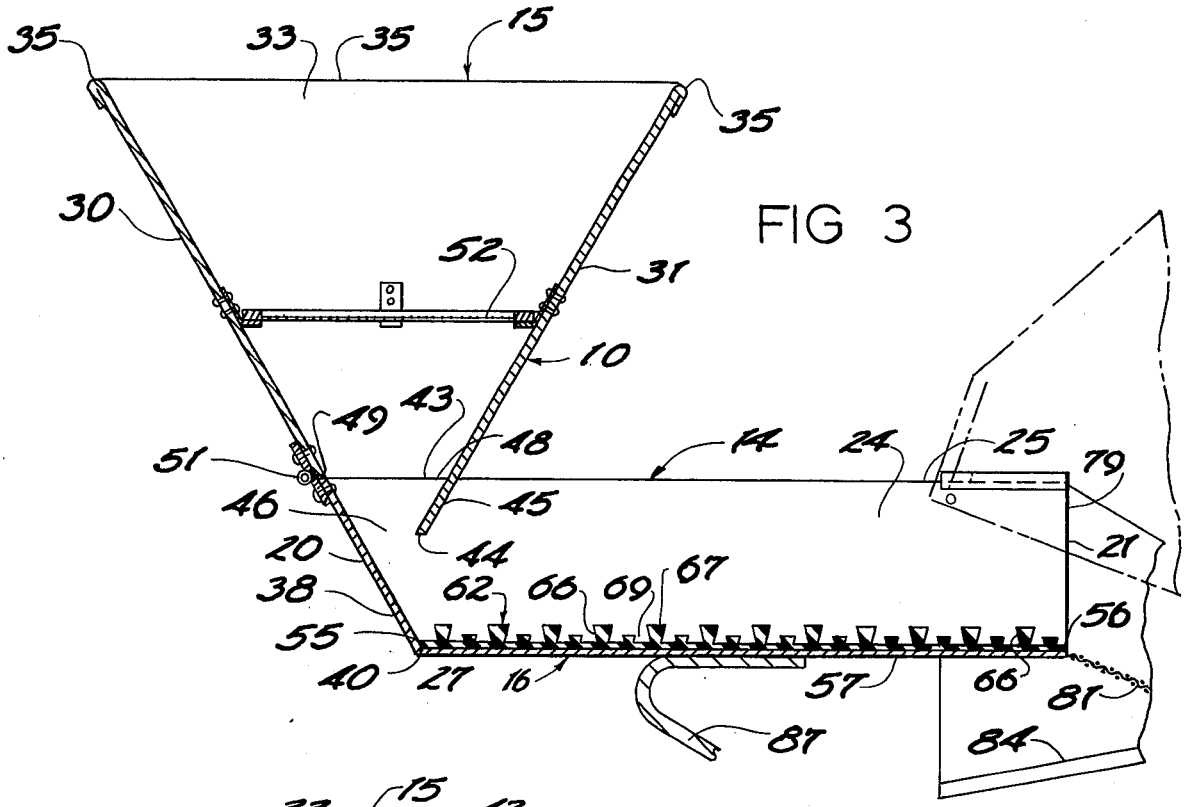
FIG. 3 is a vertical cross sectional view taken along line 3—3 in FIG. 1 illustrating the internal structure of the sluice pan.

As specifically illustrated in FIGS. 1 and 3, the sluice trough 14 extends from a head end 20 to an overflow open end 21. The trough 14 has a substantially U-shaped cross section with parallel opposing side walls 23 and 24 that terminate in upper edges 25. Side walls 23 and 24 are joined by a bottom or floor wall 27.

The hopper 15 has inclined downwardly converging walls that are individually identified as rear wall 30, forward wall 31 and side walls 32 and 33. The upper ends of the walls 30-33 terminate in upper edges 35 forming an intake opening for the sluice pan for receiving placer gravel and sand and water.

The rear wall 30 extends downwardly into the trough 14 forming an incline back wall 38 that intersects with the bottom wall at intersection 40. The side walls 32 and 33 extend downwardly terminating in edges 42 and 43 respectively that abut against and mate with the upper edges 25 of the side walls of the trough 14.

Figure 4:
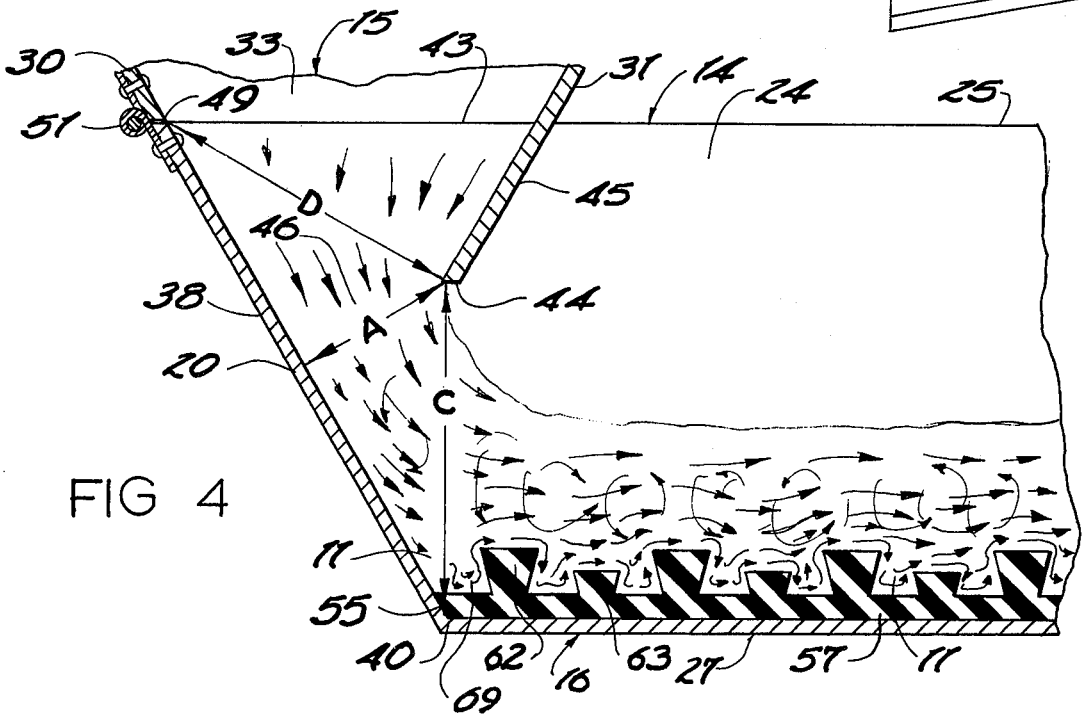
FIG. 4 is an enlarged vertical cross sectional view illustrating a throat area between a hopper and a sluice trough.

The forward wall 31 of the hopper has an inclined projecting section 45 that projects downwardly into the sluice pan 14 and is directed toward the back wall 38 terminating in a throat edge 44. The throat edge 44 forms a restricted cross section area referred to as throat and is identified with the numeral 46. The throat has the smallest cross section through which the material flows from the hopper to the sluice trough. The throat 46 may be referred to as the exit opening of the hopper communicating with the sluice trough 14. The throat 46 has a height dimension A (FIG. 4) which extends from the throat edge 44 on a line normal to the back wall 38. The width or other major dimension of the throat is dimension B which in the preferred embodiment is also the width of the trough 14 between the side walls 23 and 24.

Another important feature of this invention is that the throat edge be in vertical alignment with the intersection 40. The height distance from the intersection 40 to the edge 44 is identified as dimension C. Such vertical alignment enables the pulp to flow onto the riffle mat in a turbulent tumbling manner. Such vertical alignment prevents the pulp from being "dumped" directly onto the riffle mat and also minimizes the velocity of the pulp flow so that good mixing and agitation is obtained. It is an additional important feature of this invention that the dimension C be greater than dimension A so that the restrictive throat 46 serves as an orifice with the fluid expanding through the opening defined by dimension C.

A plane of discontinuity 48 is defined as a plane that extends horizontally through the hopper at the location of the edges 42 and 43. The plane of discontinuity 48 intersects the back wall 38 at intersection 49. The plane of discontinuity 48 represents the location in which the side walls 32 and 33 no longer converge and that the only converging portions are the rear wall 30 and the forward wall 31. At this point additional agitation and mixing of the water and the placer material take place. From the plane of discontinuity 48, the material is more rapidly mixed in a tumbling and turbulent manner as it flows through the restricted throat 46. An additional feature of this invention is that the distance from the throat edge 44 to the intersection 49, which will be referred to as dimension D, is substantially equal to the distance from the throat edge 44 to the intersection 40 (dimension C).

To separate the large particles from the placer material a grizzly screen 52 is mounted in the hopper 15. It is important that the grizzly screen 52 be located at an elevation in which the screen has a cross section at least six times greater than the restricted throat 46. The applicant has found that excellent mixing without clogging can be obtained with such an arrangement.

To assist the operator in removing the large particles and rocks from the grizzly screen, the sluice pan 10 is provided with a hinge 51 across the rear wall 30 so that the hopper may be tilted backward to dump the larger particles that will not pass through the grizzly screen 52. Various types of locking mechanisms may be utilized to lock the hopper in the configuration illustrated in FIGS. 1 and 3. No purpose is seen in describing various locking mechanisms that may be utilized. The important feature is to have the hinged arrangement to enable the larger particles to be easily dumped from the sluice pan at desired intervals.

The riffle mat 16 is elongated and extends from end 55 to end 56. The riffle mat is made of a flexible material so that the mat may be rolled into a roll either for storage or during the process of removal from the sluice pan. The riffle mat has sides 57 and 58 with the width of the mat being coextensive or somewhat larger than the inside width of the sluice trough so that the mat will be held in the sluice trough by frictional engagement of the sides 57 and 58 against the side walls 23 and 24 respectively. Preferably, the mat is made of a rubberized molded material having reinforced strands extending through the mat. The mat 16 has a base 60 with a plurality of riffles extending crossways between the sides 57 and 58. The riffles extend upward from the base 60 to engage and control the flow and pattern of flow of the pulp through the sluice trough. It is preferable that the riffles be formed integrally with the base 60. Additionally, it is preferable that the riffles have reinforced cord extending therethrough such as polyester cord to reinforce the riffles. In a preferred embodiment, the mat has main or large riffles 62 and intermediate minor or trap riffles 63 interspersed between the main riffles 62. Each of the main riffles 62 have diverging side surfaces 65 and 66 that extend upward and outward from the base terminating in a wide top surface 67. The diverging side surfaces form eddy spaces 69 adjacent to the riffles to cause the pulp to flow in a rising current on the upstream side of the riffle at a velocity that is less than the settling rate of the heavy particles and to fall on the downstream side of the riffle in an eddy turbulent configuration to deposit the heavier materials on both the up side and down side of the riffles. The minor or trap riffles 63 are preferably of a similar configuration but of a smaller size and have lesser heights than the main riffles 62. The main purpose of the minor or trap riffles 63 is to trap the heavy particles once they have been stratified beneath the lighter material. The main riffles 62 have a desired height which is indicated by the dimension E. It is important in the design of the sluice pan that the dimension E or height of the main riffles 62 be coordinated with the size of the restrictive throat 46 so that the height liquid level of the pulp flowing through the trough is at a height of at least three times the height of the riffle (dimension E). It is found that maximum efficiency can be obtained with this relationship. Additionally, it is important that the spacing between the main riffle 62 be related to the width of the top surfaces 65. For purposes of explanation, the width of the top surfaces 67 will be designated as dimension F and spacing between the main riffles as dimension G. It is preferable that the dimension G be at least twice the dimension F.

It has been found that the sluice pan as illustrated and described is quite efficient with the high percentage of the heavier materials beginning to stratify and be held by the riffles throughout the entire length of the sluice trough.

If desirable, the sluice pan 10 may be provided with an overflow seperator 75 for seperating the overflow solids by size of the pulp flowing from the overflow end 21. The separator 75 has parallel side walls 76 and 77 hinged at 79 to the side walls 23 and 24 respectively for pivotal movment from an operative position shown in solid lines in FIGS. 1 and 3, to an inoperative position shown in dotted lines in FIG. 3. The side walls 76 and 77 extend outward and downward from the overflow end 21. The separator 75 includes an inclined screen 81 extending forward and downward from the overflow end 21 for receiving the overflow pulp from the trough 14 and for permitting the fine or small size material to drop through the screen 81. The larger material rolls down the screen and out the end of the separator. A back chute 84 is provided immediately below the screen 81 to receive the material passing or dropping through the screen 81. The back chute 84 is sloped downward and inward to deposit the fine material spaced from material discharged from screen 81. It is desirable to segregate the overflow material by size so that the operator may restore the land with overflow material to meet environmental considerations.

The sluice pan 10 is constructed of very lightweight material, preferably thin guage aluminum. The sluice pan 10 is designed to be sufficiently portable to be carried on one's back. Also the pan 10 may be hand held during operation with the operator moving the pan 10 from side to side to assist the stratification process. In one embodiment, the pan 10 weighs less than three pounds.

Alternatively, the pan 10 may be supported on a bracket 87 having a mounting screw 90. The bracket 87 is constructed to enable the pan to be held at a slight inclined angle to facilitate the flow of the pulp through the trough 14. Additionally, the bracket 87 may be easily pushed from side to side to agitate the flow.

It should be understood that the above described embodiment is simply an illustration of the applicant's invention and that numerous other embodiments may be readily devised by persons of ordinary skill in the art incorporating the principles thereof. Therefore only the following claims are intended to define or limit the invention.

What is claimed is:

1. A portable sluice pan for concentrating gold-bearing placer material comprising:

an elongated channel sluice trough having a head end and an open overflow end, said trough having a U-shaped cross section with a bottom wall and opposing side walls extending from the head end to the overflow end;

a mixing hopper having an exit opening communicating with the trough adjacent the head end for receiving the placer material and water and for mixing the placer material and water to form a sluice pulp and for directing the pulp into the trough at the head end;

said hopper having inclined walls with a rear wall extending downward into the sluice trough terminating at the bottom wall of the sluice trough intersecting the bottom wall at a predetermined longitudinal location of the sluice trough;

said hopper having a forward wall extending downward into the sluice trough terminating in a throat edge which is vertically spaced from the trough bottom wall directly overlying the intersection of the rear wall of the hopper and the bottom wall of the sluice trough; and an elongated flexible riffle mat removably mounted in the trough on the bottom wall and extending from the head end to the overflow end; said riffle mat having a plurality of cross riffles spaced at intervals along the mat to permit the pulp to flow from the head end and the overflow end while causing the pulp to flow in a turbulent manner over the riffles to separate the heavier gold-bearing particles from lighter particles.

2. The portable sluice pan as defined in claim 1 wherein the elongated flexible riffle mat is constructed of a flexible rubber material.

3. The portable sluice pan as defined in claim 2 wherein the riffles having reinforcing cords imbedded therein.

4. The portable sluice pan as defined in claim 1 wherein the mat has a plurality of high riffles interspaced by low riffles.

5. The portable sluice pan as defined in claim 1 wherein the mat has a base portion with riffles projecting upward from the base into the path of the flowing pulp to create flow turbulence; and wherein at least two of the riffles have side surfaces that extend upward and outward diverging from the base to a wide top surface creating eddy spaces adjacent the riffle side surfaces to facilitate gravitational separation.

6. The portable sluice pan as defined in claim 4 wherein the high riffles have a preselected height from a mat base and a preselected riffle width and wherein the high riffles are spaced from each other along the sluice trough a distance at least twice the preselected riffle width.

7. The portable sluice pan as defined in claim 1 wherein the throat edge of the forward hopper wall is vertically spaced from the bottom wall of the trough a distance greater than the normal distance from the throat edge to the rear wall of the hopper.

8. The portable sluice pan as defined in claim 1 wherein the hopper has inclined side walls that terminate in a horizontal plane that intersects the hopper rear wall and wherein the distance between the throat edge of the forward hopper wall and the intersection of said horizontal plane with the rear hopper wall is substantially equal to the vertical distance between the throat edge of the forward hopper edge and the bottom wall of the trough.

* * * * *